US009930971B2

(12) United States Patent
Dóczi et al.

(10) Patent No.: US 9,930,971 B2
(45) Date of Patent: Apr. 3, 2018

(54) MATTRESS INSERT

(71) Applicants: András Péter Dóczi, Budapest (HU); László Mihály Pálinkás, Budapest (HU)

(72) Inventors: András Péter Dóczi, Budapest (HU); László Mihály Pálinkás, Budapest (HU)

( * ) Notice: Subject to any disclaimer, the term of this patent is extended or adjusted under 35 U.S.C. 154(b) by 0 days.

(21) Appl. No.: 15/122,972

(22) PCT Filed: Aug. 19, 2014

(86) PCT No.: PCT/HU2014/000073
§ 371 (c)(1),
(2) Date: Sep. 1, 2016

(87) PCT Pub. No.: WO2015/067974
PCT Pub. Date: May 14, 2015

(65) Prior Publication Data

US 2017/0065094 A1 Mar. 9, 2017

(30) Foreign Application Priority Data

Nov. 5, 2013 (HU) ..... 1300203 U

(51) Int. Cl.
*A47C 27/14* (2006.01)
*A47C 27/15* (2006.01)
*A47C 27/08* (2006.01)

(52) U.S. Cl.
CPC ..... *A47C 27/146* (2013.01); *A47C 27/08* (2013.01); *A47C 27/148* (2013.01); *A47C 27/15* (2013.01)

(58) Field of Classification Search
CPC ..... A47C 27/14; A47C 27/142; A47C 27/144; A47C 27/146; A47C 27/15
See application file for complete search history.

(56) References Cited

U.S. PATENT DOCUMENTS 4,047,254 A * 9/1977 Hamasu ..... A47C 27/144 5/284
4,397,053 A * 8/1983 Fanti ..... A47C 27/15 5/724
4,768,251 A * 9/1988 Baskent ..... A47C 27/146 5/722

(Continued)

FOREIGN PATENT DOCUMENTS

CN 202112704 1/2012
CN 202234187 5/2012

(Continued)

*Primary Examiner* — David E Sosnowski
*Assistant Examiner* — Rahib T Zaman
(74) *Attorney, Agent, or Firm* — Maxey-Fisher, PLLC; Stephen Lewellyn

(57) ABSTRACT

The invention is a mattress insert comprising supporting blocks (10, 12, 14) made of a foam material and arranged on a base body, said supporting blocks (10, 12, 14) are formed integrally with the base body, and said supporting blocks (10, 12, 14) comprise first supporting blocks (10) arranged with spacings from one another, and second supporting blocks (12, 14) arranged in the spacings, wherein a height of the second supporting blocks (12, 14) relative to the base body is lower than that of the first supporting blocks (10).

10 Claims, 9 Drawing Sheets

(56) References Cited

U.S. PATENT DOCUMENTS 4,860,397 A * 8/1989 Gusakov ..... A47C 27/081 297/DIG. 3
4,901,387 A * 2/1990 Luke ..... A47C 27/146 5/727
5,010,609 A * 4/1991 Farley ..... B29C 44/5654 5/730
5,025,519 A * 6/1991 Spann ..... A61G 7/05707 5/724
5,604,021 A * 2/1997 Wagner ..... A47C 27/146 428/158
5,960,497 A * 10/1999 Castellino ..... A47C 27/146 5/665
6,256,819 B1 * 7/2001 Maier ..... A47C 7/185 297/452.26
D467,118 S * 12/2002 McClure ..... D6/596
7,000,277 B2 2/2006 Cervera
7,445,839 B2 11/2008 Yamaguchi et al.
7,496,981 B2 * 3/2009 Alonso Cucurull . A47C 27/144 5/655.9
D690,536 S * 10/2013 Young ..... D6/601
8,832,889 B2 * 9/2014 Sportis ..... A47C 27/144 5/727
2003/0150061 A1 * 8/2003 Farley ..... A47C 27/146 5/736
2007/0020447 A1 * 1/2007 Yamaguchi ..... B60R 13/08 428/304.4
2008/0010753 A1 * 1/2008 Hernandez Maestre ..... A47C 27/146 5/723
2009/0013472 A1 * 1/2009 Koffler ..... A47C 21/046 5/652.1
2010/0005594 A1 * 1/2010 Rancourt ..... A47C 23/002 5/652
2010/0146706 A1 * 6/2010 Siegner ..... A61G 1/04 5/626
2010/0251864 A1 * 10/2010 Rose ..... A47C 27/144 83/13
2011/0004998 A1 * 1/2011 Losio ..... A47C 23/002 5/699
2011/0041252 A1 2/2011 DeFranks et al.
2011/0067183 A1 * 3/2011 Hawkins ..... A47C 27/144 5/740

FOREIGN PATENT DOCUMENTS

DE 102007051232 4/2009
FR 2220238 10/1974
FR 2539297 7/1984
WO 2013126972 9/2013

* cited by examiner

MATTRESS INSERT

TECHNICAL FIELD

The invention relates to a mattress insert comprising supporting blocks made of a foam material.

BACKGROUND ART

Mattresses are important constituents of the so-called "sleeping systems" (articles related to sleeping). Mattresses comprise a mattress insert that is usually covered by a liner. A mattress insert is also called a mattress core in the field of the art. In a mattress the role of the mattress insert is to provide optimal weight distribution, adequate load support, and an ergonomic sleep environment. A number of different mattress types have become widely used worldwide. These types vary greatly as far as their manufacturing technology, structural configurations, and technological constructions are concerned.

In the mattress insert according to U.S. Pat. No. 5,604,021 two or three layers of different hardness are laminated on top of one another. The hardness of a given region of the mattress can be adjusted by differently selecting the depth of grooves machined in the mattress insert, as well as the choice of the materials applied for the given layers.

In U.S. Pat. No. 7,000,277 B2 a foam spring mattress (comprising spring-shaped stubs, or in another words, blocks) is disclosed, wherein the foam springs are separated from each another by rectangular blocks also made of foam material. The spring-shaped blocks and the rectangular blocks arranged between them together form a covering surface of even height.

In DE 10 2007 051 232 A1 a mattress formed with foam springs is disclosed, wherein foam springs of different width correspond to different regions of the mattress surface.

In U.S. Pat. No. 4,901,387 a mattress comprising foam blocks is disclosed, wherein the height of the foam blocks may be different at different (e.g. leg, waist, head) regions, but the height is uniform within a given region. Such an arrangement may provide different-height support for different body regions. A similar solution is disclosed in U.S. 2011/0004998 A1, wherein surfaces of different height may be formed, for instance for supporting different body parts, by applying separate foam springs inserted in a sheet. The foam springs are fixed into the sheet adapted for joining the springs.

Foam blocks comprising spring portions and homogeneous portions of different heights and forming a load support surface of uniform height are disclosed in U.S. Pat. No. 7,496,981 B2, according to which a homogeneous mattress material is disposed in a lower-thickness layer above the taller foam blocks and in a higher-thickness layer above the lower foam blocks.

A mattress having a layered configuration, grooves, and blocks of uniform height, is disclosed in U.S. Pat. No. 7,445,839 B2. In FR 2 220 238 a mattress insert provided with diagonal grooves on a part of it is disclosed. A mattress comprising foam blocks having multiple layers of different density and firmness is disclosed in FR 2 539 297 and WO 2013/126972 A2. A common characteristics of known mattress insert arrangements comprising multiple layers having different density and firmness is that the blocks comprising the layers have the same height over the entire load surface of the mattress inserts, or for instance over a continuous region thereof corresponding to a given body region.

In U.S. Pat. No. 4,768,251 a mattress arrangement comprising foam blocks is disclosed wherein foam blocks of different heights and shapes are arranged at different regions of the mattress.

In CN202112704 U, CN202234187 U and U.S. 2011/0041252 A1 spring mattresses are disclosed wherein a spring of greater height is surrounded by springs having lower heights. Arrangements formed with springs have the disadvantage that the springs cannot be arranged with arbitrarily small spacings between them; the manner in which the springs are arranged being determined by the spatial extension of the springs. Thereby, due to the application of springs, the load support surface of such mattress inserts will have surface portions—having a relatively large size with respect to the cross sectional area of the springs—that are not supported either by the taller or by the lower-height springs. This disadvantage cannot be eliminated utilising solutions applying springs.

A common disadvantage of several widely used mattress types is that they are capable of providing sufficient support only within an extremely restricted load range, i.e. their support firmness is not dependent on the load to which the mattress is subjected to. Known mattresses are incapable of following the weight gains and weight losses of the human body, and are also not capable of providing a uniform support force for persons of different weights. Thereby, they are incapable of providing the same level of comfort for users of various weights.

A known mattress arrangement that provides adequate support for a person weighing e.g. 75 kg is incapable of adequately supporting and shape-following the body of a person weighing 100 kg. This problem is not solved even by mattress types comprising a uniform structure but consisting of sections of different firmness (ergonomic zones). Although these mattress types solve the problem of following the shape of the body more accurately, but are not capable of providing a supportive reaction force that conforms to the needs of persons having various body weights.

This problem occurs with all known mattress types, such as mattresses comprising Bonnell springs, foam mattresses, and pocket spring mattresses. Of these mattress types, pocket spring mattresses may have high-level shape-following ability, but resulting from their uniform structure (springs having homogeneous material) they are not capable of responding to different loads with differentiated reaction forces. This disadvantage is especially conspicuous in case of the spring mattress inserts according to CN202112704 U, CN202234187 U and U.S. 2011/0041252 A1 wherein the resistance of the springs can only be adjusted by adjusting a spring constant that is uniform along the entire length of the given spring. The vast majority of known mattress solutions have surface configurations wherein a single surface plane is formed.

Based on the above reasoning it can be concluded that known mattress inserts being spring-type or not, are not capable of following any change in the mass or weight distribution of the user's body, and are also incapable of fulfilling the requirements posed by the fact that users have different builds and weights.

A further problem is posed in relation to known mattresses. Mattresses are articles that are subjected to very heavy use. Consequently, the support capability and capability of even weight distribution of the mattresses gradually deteriorate over the years due to the naturally occurring structural changes and fatigue of their materials. It has to be noted here that the average mattress usage duration and replacement cycle time of households is well over ten years.

Taking into account the conditions required for healthy sleep, the changes occurring in a mattress insert due to structural fatigue over the average replacement cycle time, and the mass and shape changes the human body undergoes during that time, it is clearly seen that the disadvantages of known mattresses may appear already in a short period of time. Furthermore, due to the reasons detailed above, a significant deterioration of support and shape following capabilities is inevitable in the long run, which, in addition to uncomfortable sleep, may cause serious health, concentration, and performance problems for the user.

In view of the known solutions, there is a demand for a mattress insert that is capable of providing even body support for persons having various body weights.

DESCRIPTION OF THE INVENTION

The primary object of the invention is to provide a mattress insert which is free of disadvantages of prior art solutions to the greatest possible extent.

A further object of the invention is to provide a mattress insert that is capable of providing uniform body support for persons having various body weights.

The objects of the invention can be achieved by the mattress insert according to claim 1. Preferred embodiments of the invention are defined in the dependent claims.

BRIEF DESCRIPTION OF THE DRAWINGS

Preferred embodiments of the invention are described below by way of example with reference to the following drawings, where.

MODES FOR CARRYING OUT THE INVENTION

Figure 1:
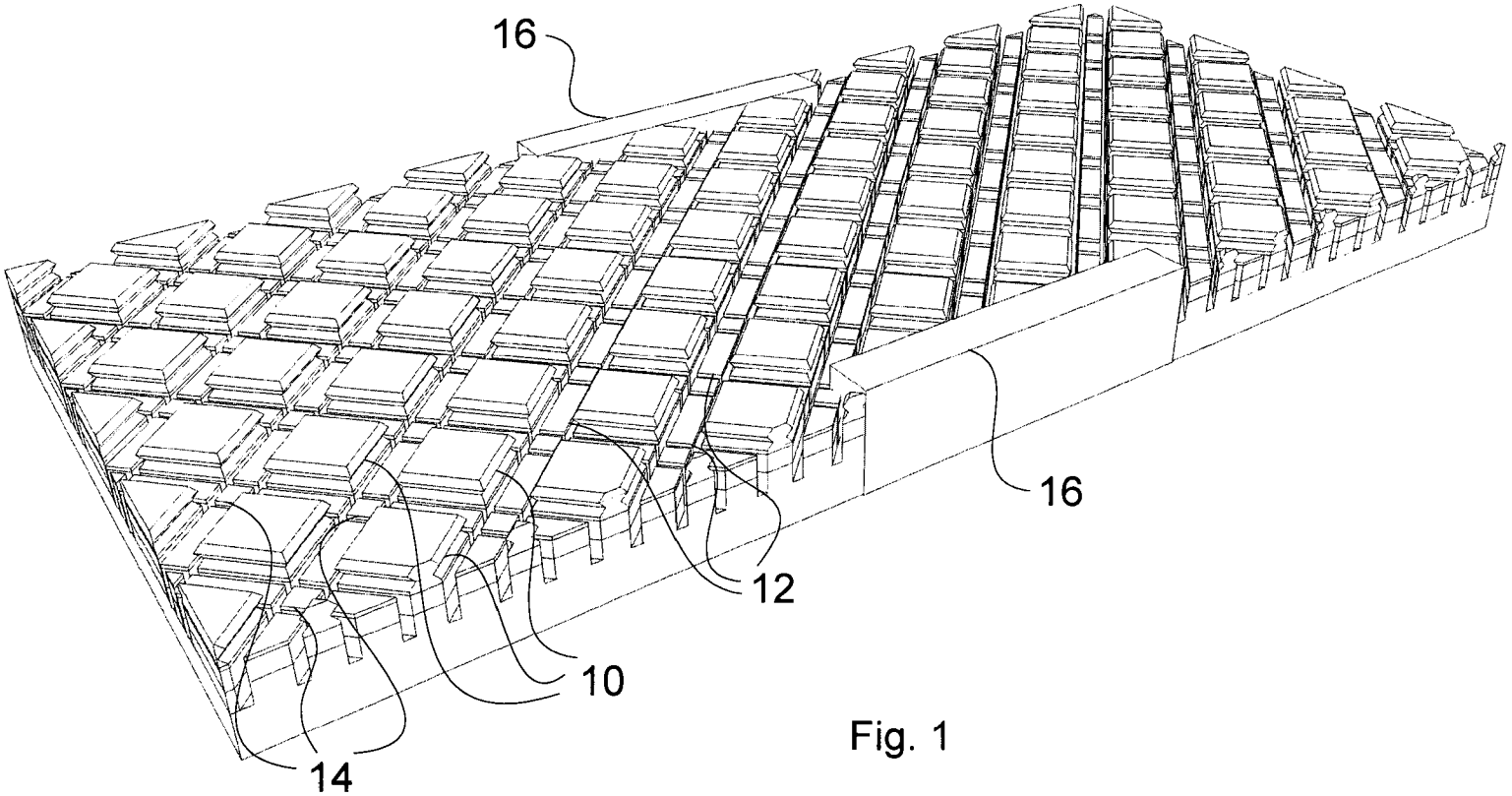
FIG. 1 is a spatial drawing of an embodiment of the mattress according to the invention.

FIG. 1 shows an embodiment of the mattress insert (in other words, mattress core) according to the invention. The mattress insert according to the invention comprises supporting blocks 10, 12, 14 made of a foam material and arranged on a base body. The supporting blocks 10, 12, 14 of the mattress insert according to the invention are formed integrally with the base body, and in the mattress insert according to the invention the supporting blocks 10, 12, 14 comprise first supporting blocks 10 arranged with spacings from one another, and second supporting blocks 12, 14 arranged in the spacings, wherein a height of the second supporting blocks 12, 14 relative to the base body is lower than that of the first supporting blocks 10. In the embodiment of FIG. 1 the base body of the mattress insert is shown, whereon the supporting blocks 10, 12, 14 are arranged.

The first supporting blocks 10 are arranged on the base body spaced apart by spacings, and the second supporting blocks 12, 14 are arranged in these spacings. According to the illustrated embodiment, the second supporting blocks 12 are arranged in the spacings in the rows of the first supporting blocks 10 including an angle of 45° with respect to the sides of the mattress insert, while the second supporting blocks 14 are arranged in spacings in the rows of the first supporting blocks 10 positioned parallel with the edges of the mattress insert.

By the integrally-formed configuration of the supporting blocks and the base body it is meant that the supporting blocks and the base body are either made as one piece, or the supporting blocks are secured to the base body by adhesive bonding. As it is described below, in the embodiment illustrated in the figures the base body and the blocks are made as one piece, while adhesive bonding is applied for securing together the layers of the mattress.

According to the invention, the second supporting blocks 12, 14, having lower height than the first supporting blocks 10, are arranged in the spacings between the first supporting blocks 10. The mattress insert according to the invention is configured in such a way for the following purpose: When the mattress insert is subjected to lower loads, the weight of the body loading the mattress is supported by the first supporting blocks 10 having larger height. In case of higher loads the higher supporting blocks are compressed to an extent that the second supporting blocks 12, 14 also come into play in supporting the load. Since the supporting blocks applied in the mattress insert according to the invention are made of a foam material, the supporting blocks having lower and larger height may be arranged arbitrarily by cutting to size and shape the foam material of the mattress insert. Furthermore, the spacings between individual first supporting blocks, as well as the gaps between supporting blocks of both types (first and second) may be set arbitrarily thanks to the application of foam material. These advantages do not occur in known mattress inserts wherein higher and lower spring blocks are arranged beside one another.

In the mattress insert according to the invention, therefore, in case it is subjected to the loads of a person having lower body mass only the higher first supporting blocks support the loads, whereas both the higher first supporting blocks and the lower second supporting blocks take part in load support in case a person having higher body mass is to be supported.

In the embodiment shown in FIG. 1 the mattress insert comprises a sitting pad 16 arranged on the longer side of thereof. The sitting pad 16 is homogeneous on the entire height of the mattress insert. The arrangement of the sitting pad 16 enables to have a sitting surface in the region of the mattress insert where a user typically sits down, since in case of a sitting user there is no need to apply different supporting blocks that fit to the load and "enter" as the load increases. The arrangement of the sitting pad 16 does not affect the operation of the central portion of the mattress insert that is typically applied for load support. This is achieved by arranging the sitting pad 16 as illustrated in the figure, i.e. the sitting pad may extend into the surface of the mattress insert to a limited extent only; whereas the dimension of the sitting pad measured along the longer side of the mattress insert may be chosen substantially arbitrarily.

Figure 2:
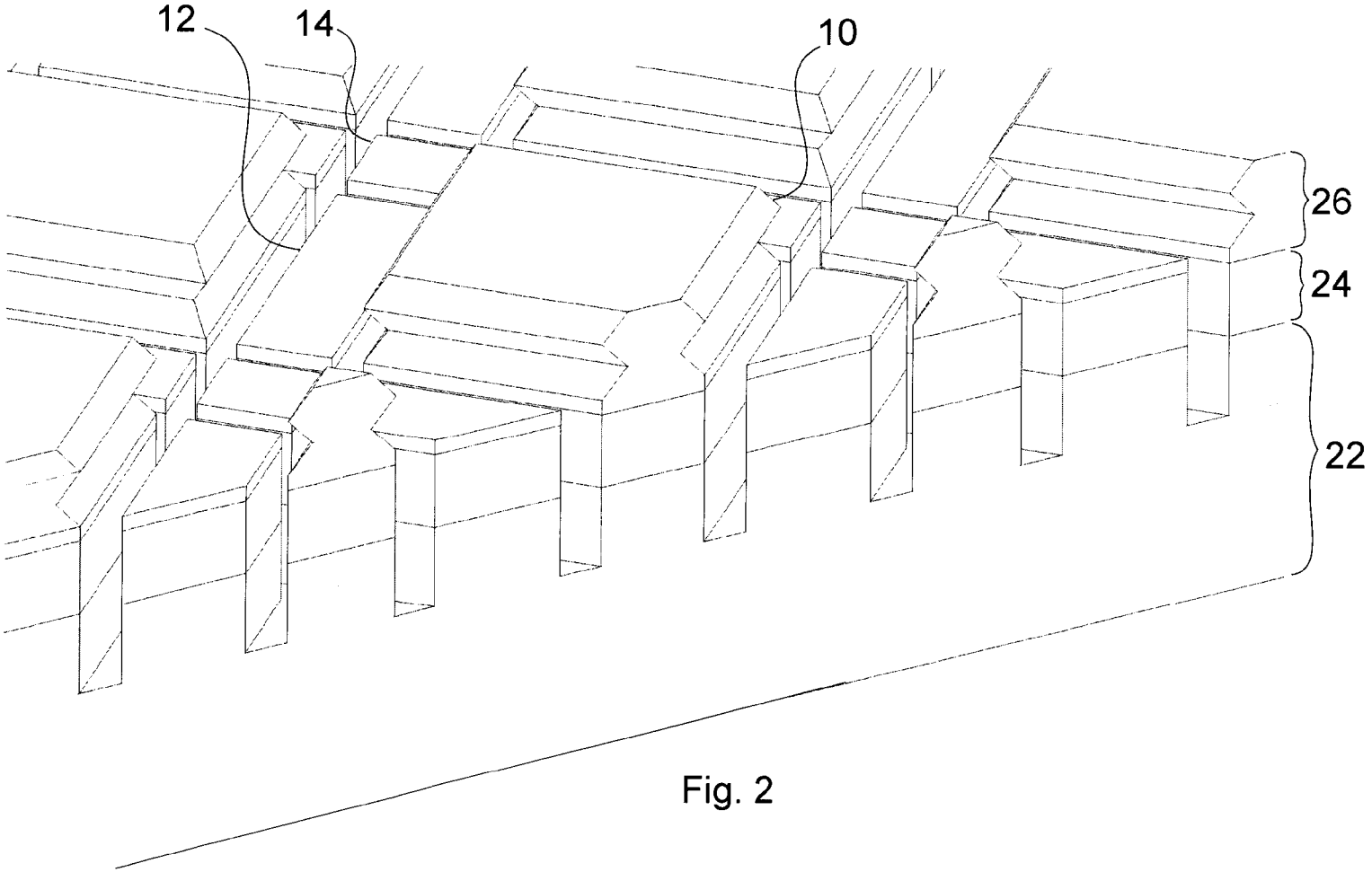
FIG. 2 shows a detail of FIG. 1.

The mattress insert according to the invention comprises layers in the embodiment shown in FIG. 1; these layers are identified in FIG. 2 by reference numerals. In an embodiment, the mattress insert according to the invention comprises a first layer 26, and a second layer 24 made of a harder material than the first layer 26 and said second layer 24 is attached to the side of the first layer 26 which faces the base body, wherein the first layer 26 and the second layer 24 are arranged parallel with the base body.

In the embodiment shown in FIG. 2 the invention further comprises a third layer 22 made of a softer material than the second layer 24 and arranged parallel with the first layer 26 and the second layer 24, wherein the third layer 22 comprises the base body.

The layers of the mattress insert according to the invention are preferably made of a foam having a density of 30-60 kg/m3. A foam material having lower density (and lower manufacturing costs) than the material of the first layer 26 and the second layer 24 may be applied for making the third layer 22 that affects the comfort of the mattress insert to a smaller extent than the first and second layers. The first layer 26 and the second layer 24 may have the same density; while the first layer 26 is softer than the second layer 24. The hardness of the foam materials applied for making the first layer 26 and the second layer 24 may be compared applying e.g. the CLD (compression load deflection) test method (www.sydney-heath.com/materials/polyurethane-foams/test-methods). Other methods may also be applied for comparing the hardness of the applied materials. The second layer 24 is preferably at least 10% harder than the first layer 26; our experiments indicate that a differentiated reaction force (to be described in detail below) may preferably be generated by this hardness difference. Our experiments have also shown that the present embodiment of the mattress according to the invention is best suited for universal use—i.e. use by persons of any body weight—in case the second layer 24 is 20-70% harder than the first layer 26. Measured applying the CLD (25) method (cf. www.qualityfoam.com/polyurethane-glossary.asp and www.sydney-heath.com/materials/polyurethane-foams/test-methods) the hardness of the first layer 26 is preferably between 25 and 50 kPa. The CLD (25) method is characterised by that the sample of a given material is subjected to a compression of 25% in the third phase of the test measurement described in the referenced documents.

Therefore, the embodiment of the invention illustrated in FIG. 2 has a three-layer configuration. In the embodiment illustrated in the figures the ratio of the thicknesses of the layers is 1:1:3 (first layer 26, second layer 24, and third layer 22), but other thickness values may also be applied in the mattress insert according to the invention.

The two- and three-layer arrangements described above allow for generating a reaction force differentiated according to the load as detailed below: The topmost layer (according to the figures), which is located farthest from the base body as shown in the figures, is made of a softer foam material than the layer arranged closer to the base body, i.e. the second layer that is situated under the first layer according to the figures. Thanks to this choice of materials the generated reaction force gradually increases due to the elastic compression of the higher first supporting blocks as the softer first layer gets compressed to a greater extent. This reaction force, which provides for support, is generated by applying load to the mattress insert. The advantages related to the application of multiple layers also cannot be achieved applying a spring mattress insert, since the springs have spring constants that remain the same along their entire length.

In case the higher first supporting blocks are compressed to an extent where the height of the compressed first supporting blocks is the same as the height of the second supporting blocks, the latter also start providing support; and for compressions greater than this, the support is provided by both the first supporting blocks and the second supporting blocks.

Since in the present embodiment the material of the second layer is harder than the material of the first layer, the first layer is compressed more easily, while greater loads are required for compressing the harder second layer. Accordingly, (in case of lower loads) typically the first layer gets compressed first, followed by the second layer above a given load value. Naturally, the harder second layer gets compressed to some extent also in case of lower load forces, but for lower loads the softer first layer plays the dominant role.

In an embodiment of the invention a side of the second layer 24 which is the farther of the sides from the base body is arranged farther from the base body than 90%, preferably 95%, of the height of the second supporting blocks 12, 14 measured from the base body. Such an embodiment is illustrated in FIG. 2. As shown in FIG. 2, the first layer 26 is only present at the topmost portion of the second supporting blocks 12, 14. According to FIG. 2, therefore, a thin, softer-material layer is disposed at the top of the supporting blocks 12, 14, but the portion of the supporting blocks 12, 14 under this top part is made of the harder material applied of the second layer 24. Applying this configuration may provide that the "hardening" of the mattress insert, i.e. the generation of higher support forces occurs substantially only when the second supporting blocks 12, 14 start to take part in providing load support. The effect occurs substantially at this instance because before that the very thin foam layer of the material of the supporting blocks 12, 14 that belongs to the first layer 26 has to be compressed. In other embodiments the side of the second layer which is farther from the base body is located higher than the height of the second supporting blocks measured from the base body, i.e. it is situated in the portion of the first supporting blocks that extends above the second supporting blocks.

In the embodiment illustrated in FIG. 2 the mattress insert also comprises the third layer 22 that is made of a softer material than the second layer 24. The third layer 22 also comprises the base body, i.e. the third layer and the base body are made as one piece. For making the third layer 22 it is preferred to select a material softer than the second layer 24, as the third layer 22 has no major role during the gradual assumption of load, the significant deformations taking place in the first layer 26 and the second layer 24. The most significant role in providing the gradually changing degree of support is played by the portions of the first supporting blocks 10 and the second supporting blocks 12, 14 lying in the first and second layers 26, 24.

In the embodiment of the invention that is shown in FIG. 2, the layers 22, 24, 26 are secured together by adhesive bonding. The multilayer-configuration embodiments of the mattress insert according to the invention may be manufactured by adhesively joining foam sheets made of the materials of the different layers (the sheets may be bigger in size than the size of the mattress insert), and then first cutting out the rectangular portions corresponding to the individual mattress inserts, and subsequently forming, by cutting the foam to shape (for instance in a single stage, in two directions), the first supporting blocks and the second supporting blocks of the individual mattress inserts. According to the above, the multi-layer embodiments comprise two or more layers, but further layers may also be arranged.

As it is shown in FIGS. 1 and 2, the second supporting blocks 12, 14 are arranged in the spacings spaced apart from the first blocks 10 with a first gap. The first gap is the gap separating the first supporting blocks 10 from the second supporting blocks 12, 14. In the embodiment illustrated in the figures each first supporting block 10 is preferably surrounded by eight second supporting blocks 12, 14, and the second supporting blocks are spaced apart from one another with a second gap. The first gaps and the second gaps preferably ensure that the first supporting blocks 10 and second supporting blocks 12, 14 may be compressed independently of one another. The supporting blocks 10, 12, 14 may protrude sideways as they are compressed. These protrusions occurring under load may be accommodated in the gaps.

The mattress insert according to the invention may have such embodiments wherein the first supporting blocks and the second supporting blocks are not separated by a gap. In this case, the independent compressibility of the blocks may for instance be provided by separating (cutting) the supporting blocks from one another down to the base body.

The base body preferably ensures the required movement of the supporting blocks, and the required stiffness of the mattress insert. In case an overly thin base body is applied, the supporting blocks would be able to move completely freely independent of one another, and therefore, for the supporting blocks to perform their role adequately it is expedient to utilise a base body that is thicker than a certain minimum thickness. As shown also in the figures the thickness of the base body is expediently at least 30%, particularly preferably at least 50%, of the height (i.e. the dimension perpendicular to the base body) of the first supporting blocks. The thickness of the base body is also affected by the desired application: above a certain thickness the thickness of the applied base body may be arbitrarily large. In addition to increasing the thickness of the base body, the adequate movement of the supporting blocks and the required stiffness of the mattress insert may be provided for in other manners.

In the embodiment illustrated in FIGS. 1 and 2 the size of the first supporting blocks 10 in a direction parallel with the base body is at least twice the size of the spacing. This condition may be fulfilled by applying supporting blocks of any (e.g. circular) cross-sectional shape. In an embodiment of the invention the cross section of the first supporting blocks 10, 12, 14 taken in a direction parallel with the base body is rectangular. Furthermore, in the embodiment shown in FIGS. 1 and 2 the cross section of the first supporting blocks 10 taken parallel with the base body is square in shape, and each first supporting block 10 is surrounded by four rectangular cross-section second supporting blocks 12 arranged along its sides and four square cross-section second supporting blocks 14 arranged near its corners.

This arrangement of the second supporting blocks 12, 14 around the square cross-section first supporting block 10 is preferred because thereby the second supporting blocks 12, 14 are arranged in a regular manner around the first supporting blocks 10, and, thanks to the manner in which the second gaps are arranged the second supporting blocks 12, 14 may also be displaced with respect to one another.

Arranging the first supporting blocks and the second supporting blocks according to the above condition preferably allows that the wider first supporting blocks applied in such embodiments—which assume the load in case of lower load values—provide a significantly larger surface area with their top portions than the second supporting blocks "helping" in case of higher load values. Thereby the load is distributed more evenly on the higher first supporting blocks, and the second supporting blocks start providing support only in case of higher load values. It is at the same time more expedient to cover with the softer-material first supporting blocks a greater portion of the loaded side of the mattress insert, since the soft blocks may thus provide a more even support surface. This large surface portion is "complemented" by the "helping" second supporting blocks in case at certain regions of the large surface portion that are subjected to higher loads the higher first supporting blocks are compressed to a sufficient extent.

In an embodiment of the invention at least the portion of the first supporting blocks 10 extending beyond the second supporting blocks 12, 14 with respect to the base body has a bellows-like shape having a longitudinal axis perpendicular to the base body. In the embodiment illustrated in the figure, preferably only the portion of the first supporting blocks 10 extending beyond the second supporting blocks 12, 14 has a bellows-like shape, since it is this portion that undergoes the largest deformation under load (it is compressed when subjected to a very wide range of possible loads, but can withstand loads in case of only very small loads). The bellows-like configuration provides for adequate flexibility and dynamics.

Figure 3:
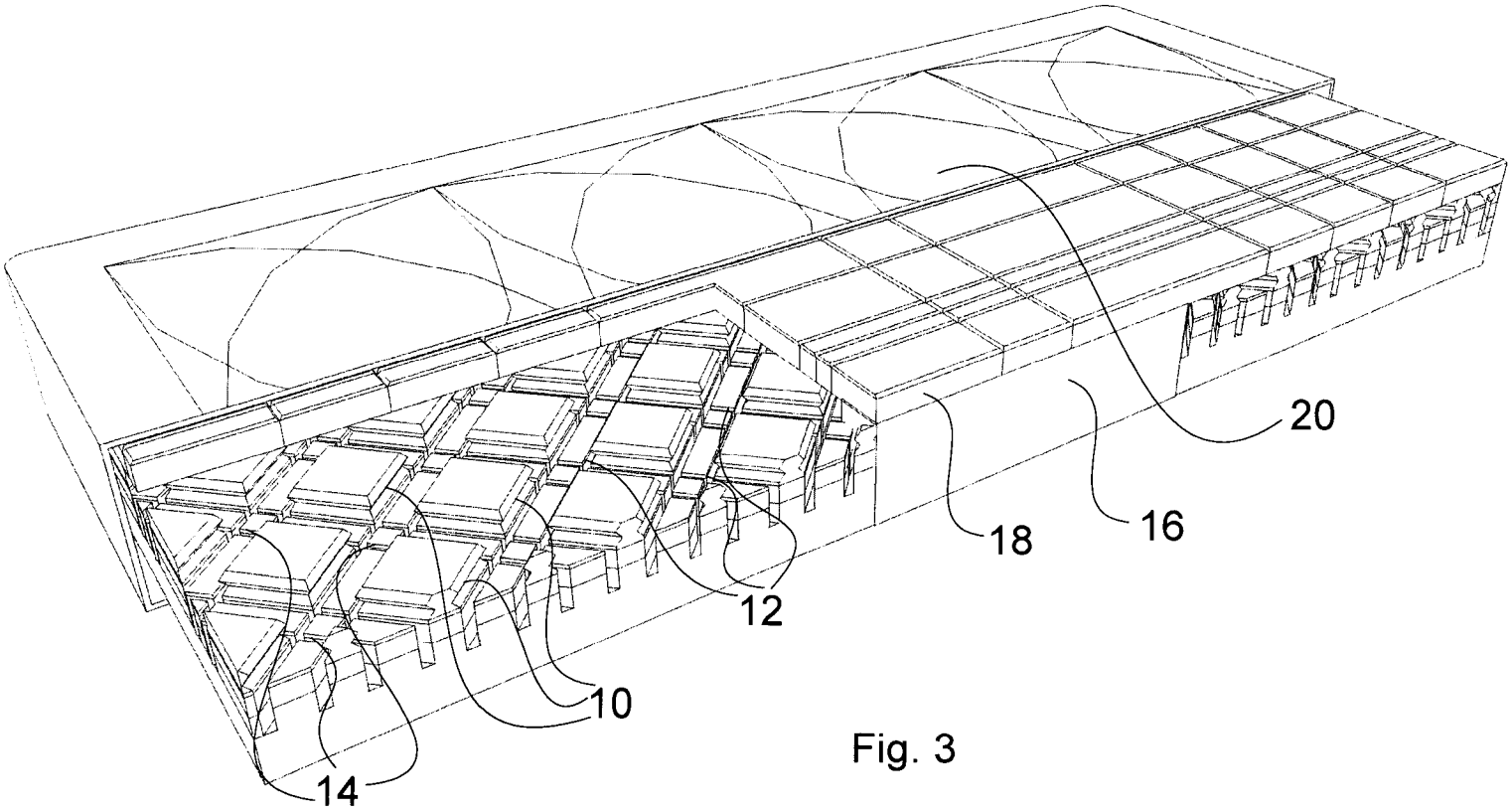
FIG. 3 illustrates the mattress according to FIG. 1, fitted with a cover layer and a liner.

The mattress insert according to the invention is illustrated in FIG. 3 in such a way that it is provided with a load distribution layer 18 arranged on the side opposite the base body, where the load distribution layer is supported on a plane defined by top parts of the first supporting blocks 10. Also, as shown in FIG. 3, the mattress insert covered by the load distribution layer 18 is covered with a liner 20. The load distribution layer 18 is adapted for spreading the load to which the mattress insert is subjected across the loaded side of the insert. In use, the mattress comprising the mattress insert typically bears the load of a person's body lying thereon. The human body subjects different portions of the mattress insert to different loads. Thus, by the inclusion of the load distribution layer 18 it may be provided that this load is distributed over more blocks than in the case where the mattress insert is applied without a load distribution layer 18. In which latter case the use of the mattress insert would also be less comfortable.

By distributing the load over more supporting blocks the mattress insert according to the invention operate more effectively, since by the application of the load distribution layer 18 the body is supported over an increased surface area, with the blocks of the same height behaving substantially the same way, and—because of the improved load distribution—with the lower-height second supporting blocks "entering" only when higher loads are present.

In an embodiment of the invention the second supporting blocks 12, 14 have a height that is lower than the height of the first supporting blocks 10 by 0.5 to 5 cm, preferably by 1 to 3 cm, and particularly preferably by 1 to 2 cm. Our experiments carried out during the development of the mattress insert according to the invention have shown that for height differences under 0.5 cm the smooth, gradualness of load assumption between the first and second supporting blocks becomes hindered as load is gradually increased, since the second supporting blocks start operating already at lower load values. It is not preferred to apply height differences above 5 cm, as such height differences cannot be effectively bridged even by applying a load distribution layer 18 for optimal surface comfort. The height difference between the blocks is preferably at least 1 cm, above which the mattress insert is capable of responding to loads in a relatively wide range. Applying a load distribution layer 18, height differences up to 3 cm may be bridged so that the inhomogeneities of the resulting mattress surface caused by the top portions of the first supporting blocks 10 are not felt as a disturbance by the user. The preferred height difference range to be applied is 1-2 cm. According to our experiments, the range of loadability is widest and the comfort of the mattress is best in case the height difference is within this range. These height difference values are for a normal-sized mattress insert, to be used by adults.

Figure 5:
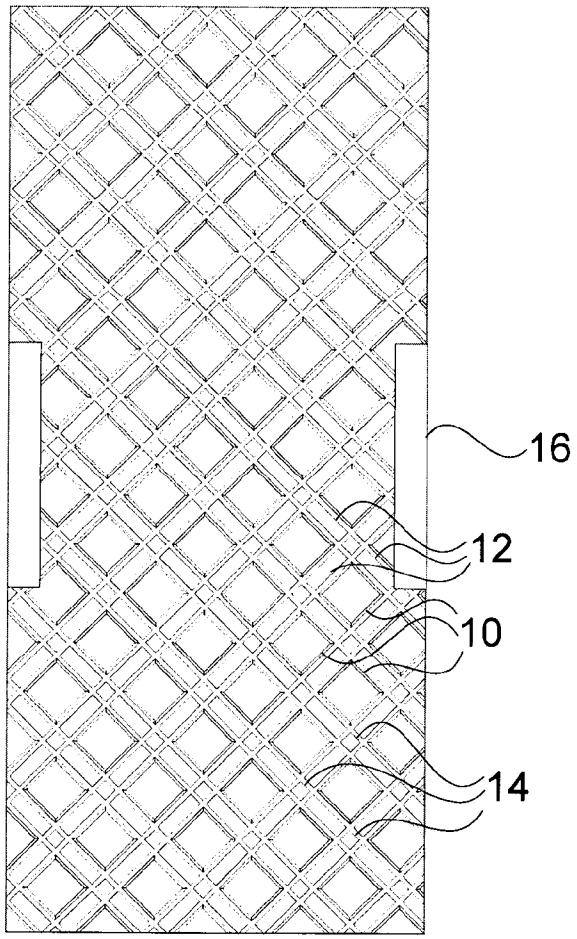
FIG. 5 is the top view of the embodiment of FIG. 1 with the mattress insert being fitted with a sitting pad.
Figure 4:
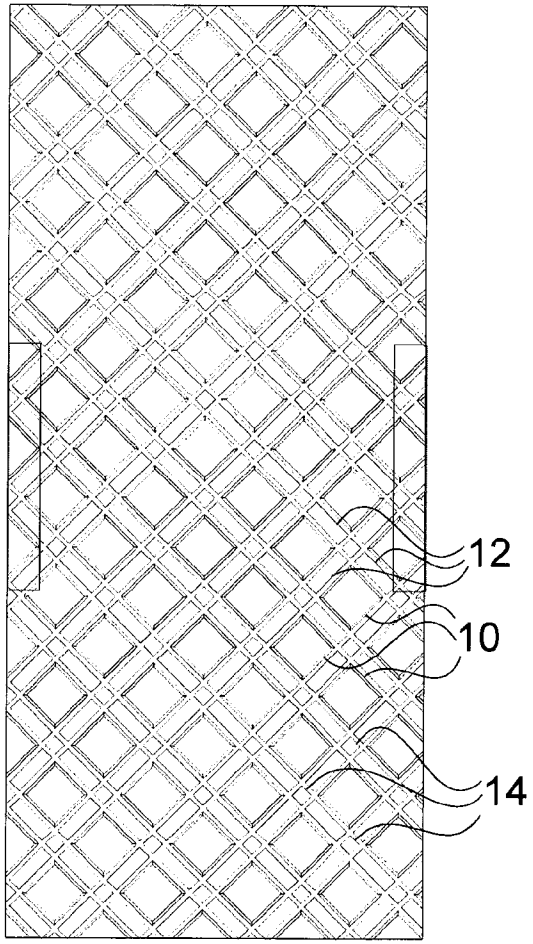
FIG. 4 shows the top view of the embodiment of FIG. 1, before the sitting pad is cut out.

FIGS. 4 and 5 show a top plan view of the embodiment of the inventive mattress insert illustrated in the previous figures before cutting out the portion belonging to the sitting pad 16 (FIG. 4: the cutting contour of the sitting pad 16 is shown), and after adhesive joining the sitting pad 16 (FIG. 5: the homogeneous configuration of the sitting pad 16 is shown).

The pattern formed on the load bearing surface of the mattress insert by the first supporting blocks 10 and the second supporting blocks 12, 14 is shown especially clearly in FIGS. 4, 5. The pattern formed by the blocks 10, 12, 14 does not necessarily extend over the entire load supporting surface, it may be omitted for example near the corners of the mattress inserts.

According to the present embodiment the blocks 10, 12, 14 are formed by making cuts at an angle of 45° with respect to the sides of the rectangular mattress insert (the bellows-shaped top portion of the first supporting blocks 10 may be formed by making further cuts). The supporting blocks may also be formed by making cuts at an angle of 90° or at any other angle with respect to the sides of the mattress insert. The shape of the pattern at its edges is of no major importance; the pattern may be terminated in any manner as determined by the exact dimensions of the mattress insert.

Figure 6:
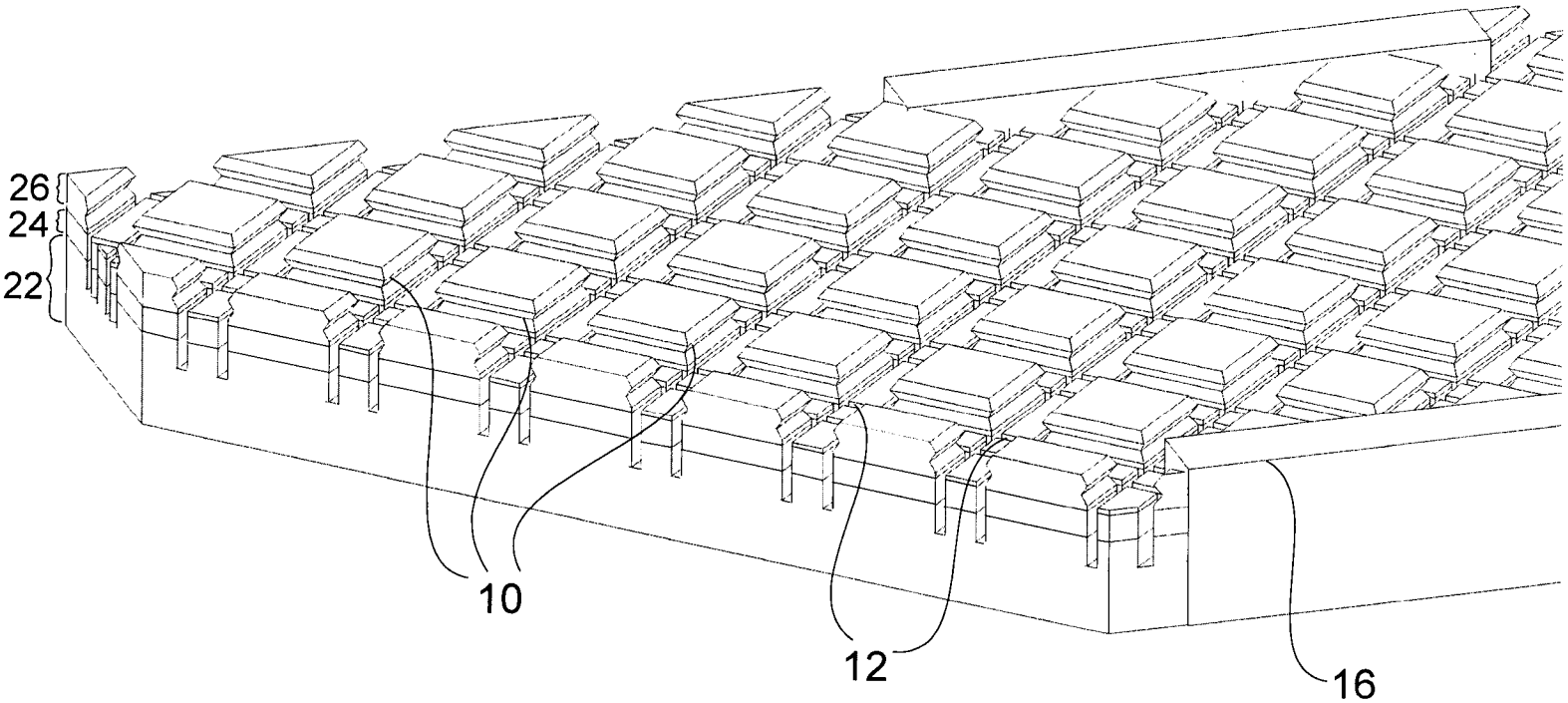
FIG. 6 illustrates the embodiment of FIG. 1, showing a section taken along a row of the first supporting blocks.
Figure 7:
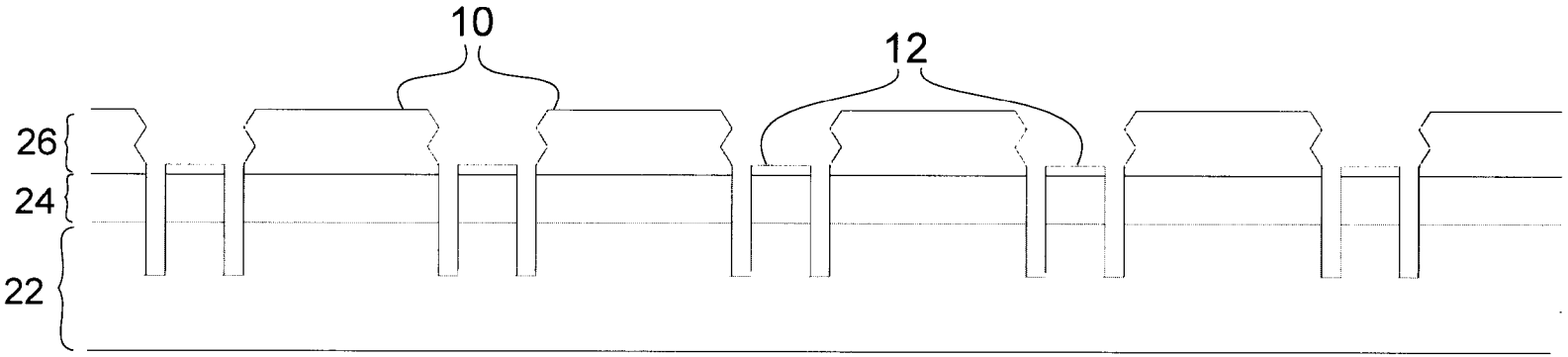
FIG. 7 shows the front view of the section shown in FIG. 6.
Figure 8:
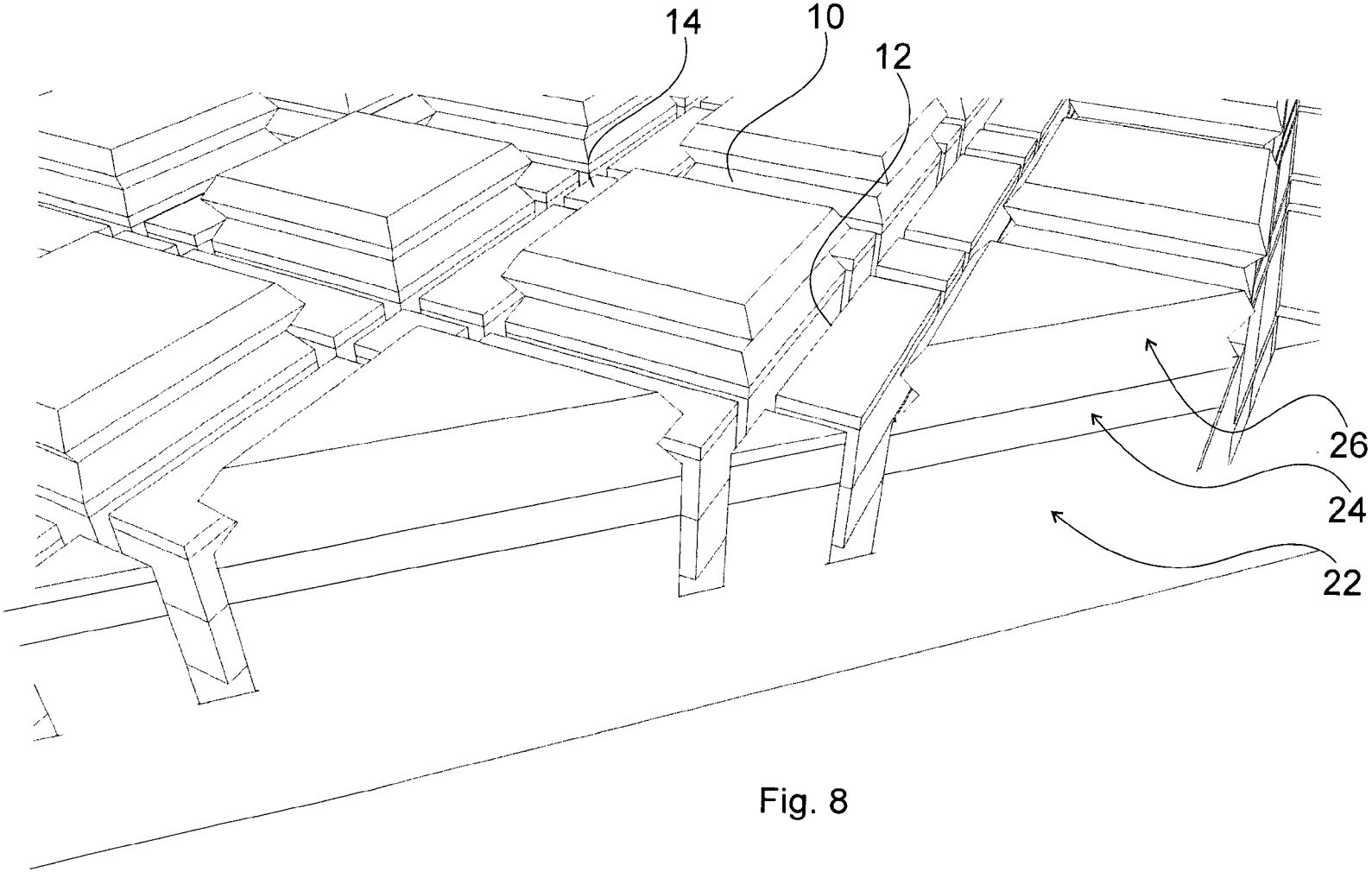
FIG. 8 illustrates the embodiment of FIG. 1, showing a section taken at 45° with respect to the row of the first supporting blocks.

In FIG. 6 the embodiment illustrated in the previous figures is shown cut along a row of the first supporting blocks 10. As shown also in this figure, the second layer 24 preferably extends along the whole mattress insert, between the first layer 26 and the third layer 22. It is also clearly shown that, in addition to the top portions of the first supporting blocks 10, a thin layer disposed on the top portions of the supporting blocks 12 is also part of the first layer 26. FIG. 7 shows a side view of the mattress insert cut along the line shown in FIG. 6. The figure illustrates clearly the multilayer structure of the present embodiment of the mattress insert, as well as the relative positions of the individual layers 22, 24, 26 inside the mattress insert. It is also shown that the bottom portions of the blocks and the base body are made from one piece.

The embodiment of the mattress insert illustrated in the previous figures is shown next along a cut made at an angle of 45° with respect to the direction of the cut illustrated in FIG. 6. According to this figure, the mattress insert is cut along a diagonal of the top part of the first supporting blocks 10 and the top parts of the supporting blocks 14. The multilayer configuration is shown also in this figure.

Figure 9:
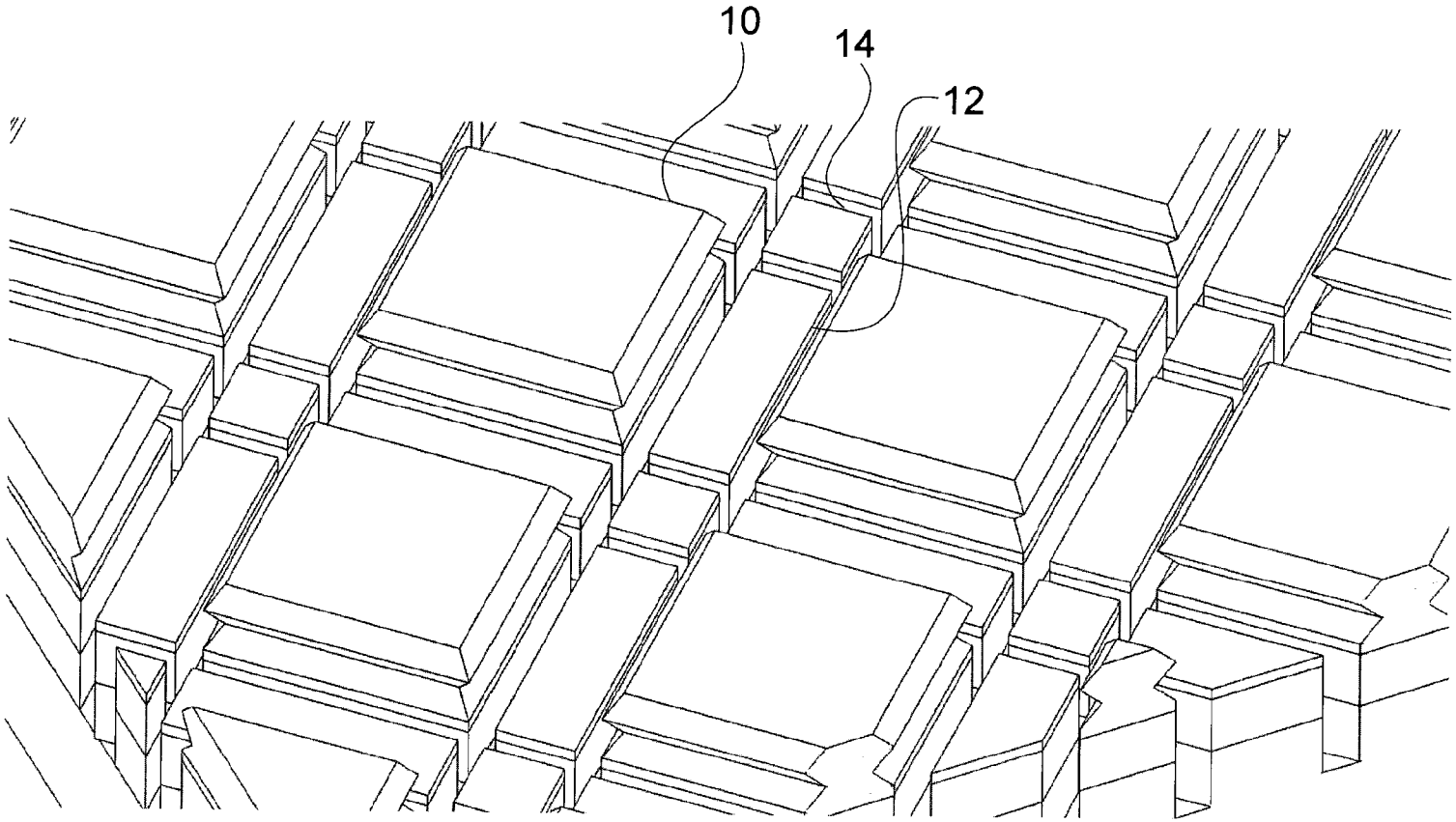
FIG. 9 shows a detail of FIG. 1.
Figure 10:
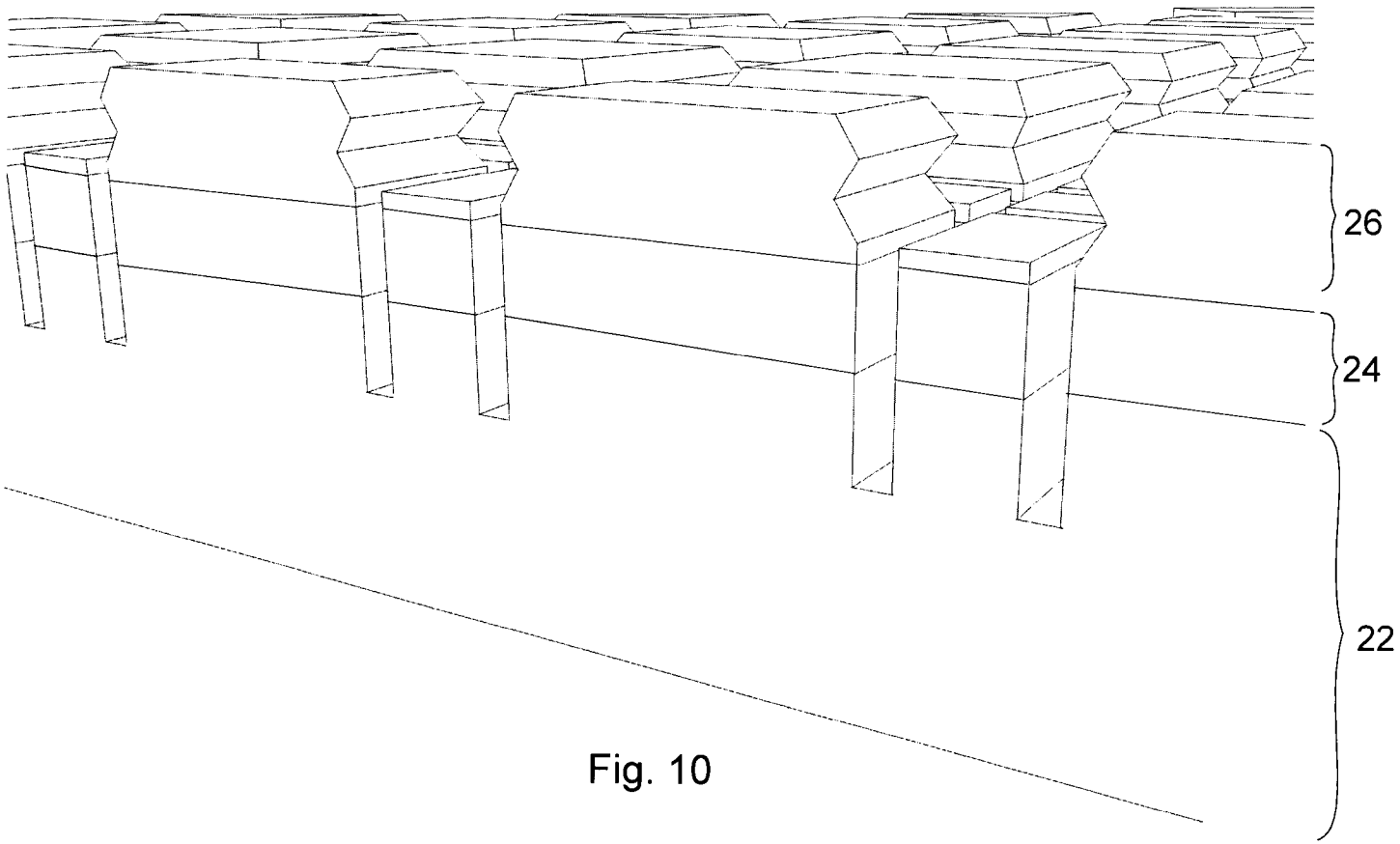
FIG. 10 shows a detail of FIG. 6.

FIG. 9 shows a detail of FIG. 1. In this detail the edge of the mattress insert according to the present embodiment is shown. The view shown in the figure clearly illustrates the structural configuration of the blocks 10, 12, 14. In FIG. 10 the above described embodiment of the mattress insert is illustrated by a view along the cut according to FIG. 6; the layer structure of the mattress insert and the gaps formed between the supporting blocks 10 and 12 are clearly shown in this figure. In the illustrated embodiment the base body is also defined by the gaps between the supporting blocks 10, 12, 14; the gaps extend downward as far as the top side of the base body.

Supporting blocks are alternatively called shape-cut units.

Ergonomic zones are sections formed on the mattress or inside the mattress insert, the zones being arranged lengthwise (in the lying direction) and extending along the entire width of the mattress insert. In known mattresses, ergonomic zones are adapted for facilitating the following of uneven body weight distribution and the ergonomic adaptation to the shape of the body by the mattress insert. The different ergonomic zones are subjected to different loads, and therefore some ergonomic zones are made of harder, while others are made of softer materials. Mattresses are subjected to the greatest load at the waist region. Accordingly, some known mattresses are reinforced in the waist region of the mattress in some way, for instance by including a stronger, thicker, larger-diameter spring, or by including transversal profiles (typically 2-5 cm-wide strips) usually made of foam or coconut fibre. The fundamental disadvantage of these known solutions is that they are not capable of providing the same level of comfort for users of different body structures. They respond differently to the loads posed by a person weighing 100 kg who is 200 cm tall, and by a person who also weighs 100 kg but is only 150 cm tall. Supporting the weight of a taller person who is not heavy at the waist region requires smaller reaction forces than supporting the weight of a waist-heavy person (e.g. a person 150 cm tall weighing 100 kg).

The mattress insert according to the invention also eliminates this disadvantage, since due to its configuration a reaction force exactly corresponding to the load of the body lying thereon is generated, for instance at the waist region (and at all other differently loaded regions). In the mattress insert according to the invention the first and second supporting blocks are compressed in all regions of the load-bearing surface to an extent corresponding to the load the given region is subjected to. Thereby, the mattress insert according to the invention may behave in such a way that in a region subjected to higher load the first supporting blocks are compressed to such an extent that they reach the level of the second supporting blocks, and thus the second supporting blocks also take part in providing the support force, while in other, lower-load regions support is provided only by the first supporting blocks, and therefore different support forces are provided in the different regions.

Considering the above mentioned example, the mattress insert according to the invention provides lower support force in the same region for supporting the waist of a person 100 kg/200 cm than for supporting the waist of a person of 100 kg/150 cm. The same principle is also applicable to the case involving two persons with different weights—60 kg and 120 kg—, since for the lower-weight person only such an amount of reaction force is provided at the waist region that is necessary but not uncomfortable, whereas for the person weighing 120 kg a much larger support force is provided by the mattress insert at the waist region.

A further advantage of the mattress insert according to the invention is related to the fact that although the waist region is located in a given interval for different body shapes and heights, shoulder regions may be situated differently. There exist a number of known solutions comprising shoulder regions (fitted to body heights) corresponding to these requirements, but these are usually manufactured to order, and cannot follow the changes of the body. The mattress insert according to the invention, however, is capable of following the changes of the body, as well as of fulfilling the requirements posed by different body heights, since—as it is illustrated in the figures—the load-bearing surface preferably has a homogeneous configuration. Therefore, the mattress insert according to the invention does not have ergonomic zones, because due to the inclusion of the supporting blocks adapting to the shape of the body ergonomic zones are not required. The mattress insert according to the invention provides load support over the entire load-bearing surface that is suited to the user's body shape and other needs.

The invention is, of course, not limited to the preferred embodiments described in details above, but further variants, modifications and developments are possible within the scope of protection determined by the claims.

The invention claimed is:

1. A mattress insert comprising:

a base body;

first supporting blocks and second supporting blocks made of foam material, arranged on the top of the base body, and formed integrally with the base body;

the first supporting blocks arranged with spacings from one another and the second supporting blocks arranged in the spacings between the first supporting blocks;

wherein a height of the second supporting blocks relative to the bottom of the base body is lower than a height of the first supporting blocks relative to the base body; and gaps or cuts are formed between the first supporting blocks and the second supporting blocks, the first supporting blocks and the second supporting blocks being next to each other are compressible independently of one another, wherein the gaps or the cuts are perpendicular to the bottom of the base body.

2. The mattress insert of claim 1, wherein the second supporting blocks are arranged in the spacing separated from the first supporting blocks by a first gap.

3. The mattress insert of claim 2, wherein at least one of the first supporting blocks is surrounded by a plurality of second supporting blocks, and wherein the second supporting blocks are spaced apart from one another by a second gap.

4. The mattress insert of claim 1, wherein a size of the first supporting blocks taken in a direction parallel with the base body is at least twice a size of the spacing.

5. The mattress insert of claim 1, wherein a portion of the first supporting blocks that extends beyond the second supporting blocks with respect to the base body has a bellows-like shape having a longitudinal axis perpendicular to the base body.

6. The mattress insert of claim 1, wherein a cross-section of supporting blocks taken in a direction parallel with the base body is rectangular shape.

7. The mattress insert of claim 6, wherein a cross-section of the first supporting blocks taken in a direction parallel with the base body is square shape, and a first supporting block is surrounded by four rectangular cross-section second supporting blocks arranged along its sides and four square shape cross-section second supporting block arranged near its corners.

8. The mattress insert of claim 1, wherein the second supporting blocks have a height that is lower than a height of the first supporting blocks by 1 to 2 cm.

9. The mattress insert of claim 1, further comprising:

a sitting pad being homogeneous on an entire height of the mattress insert is arranged on at least one longitudinal side of the mattress insert.

10. The mattress insert of claim 1, further comprising:

a load distribution layer arranged on a side of the mattress insert opposite of the base body, and wherein the load distribution layer is supported on a plane defined by top parts of the first supporting blocks.

* * * * *